US005615501A

United States Patent [19]

Rice

[11] Patent Number: 5,615,501

[45] Date of Patent: Apr. 1, 1997

[54] ILLUMINATED VEHICLE DISPLAY DEVICE

[76] Inventor: Samuel A. Rice, 400 N. Chalet Ave., Tucson, Ariz. 85748

[21] Appl. No.: 536,170

[22] Filed: Sep. 29, 1995

[51] Int. Cl.[6] ..... G09F 13/08

[52] U.S. Cl. ..... 40/205; 40/574

[58] Field of Search ..... 440/204, 205, 440/206, 564, 570, 574, 714, 716, 642; 362/812

[56] References Cited

U.S. PATENT DOCUMENTS

| | | | |
|---|---|---|---|
| 2,045,863 | 6/1936 | Marsala . | |
| 2,108,591 | 2/1938 | Marks . | |
| 2,122,027 | 6/1938 | Czarny et al. . | |
| 2,124,829 | 7/1938 | Rioux . | |
| 2,147,560 | 2/1939 | Schupbach | 40/205 |
| 2,156,753 | 5/1939 | Dunnam et al. . | |
| 2,156,806 | 5/1939 | Ducey . | |
| 2,171,820 | 9/1939 | White . | |
| 2,203,785 | 6/1940 | Hoover et al. . | |
| 2,305,372 | 12/1992 | Ayldelotte . | |
| 2,305,750 | 12/1992 | Vokaty . | |
| 2,875,539 | 3/1959 | Gladd . | |
| 3,150,960 | 9/1992 | Redick . | |
| 3,349,511 | 10/1967 | Aronoff . | |
| 3,406,475 | 10/1968 | O'Donnell . | |
| 3,521,391 | 7/1970 | Murai . | |
| 3,921,324 | 11/1975 | Flannery . | |
| 4,475,298 | 10/1984 | Munoz . | |
| 4,805,331 | 2/1989 | Boggess et al. | 40/611 X |
| 4,831,755 | 5/1989 | Rodriquez | 40/564 X |
| 5,018,291 | 5/1991 | Pasquale et al. | 40/642 |
| 5,073,842 | 12/1991 | Monroe . | |
| 5,177,889 | 1/1993 | Ching Hwei . | |

FOREIGN PATENT DOCUMENTS

| | | | |
|---|---|---|---|
| 1273835 | 11/1960 | France | 40/209 |

*Primary Examiner*—Brian K. Green

*Attorney, Agent, or Firm*—Richard R. Mybeck; Peter B. Scull

[57] ABSTRACT

An illuminated vehicle display device comprising a flat back plate having a light source disposed thereon, and a front, box-like housing member which has a rearwardly disposed opening so that the housing member encloses the light source when it is detachably attached to the flat back plate. The front housing member has a partially translucent/transparent (i.e. partially non-opaque) panel disposed in a window defined through its front wall. A plurality of protruding tab members defined on the inside faces of one or more walls of the housing member coact with a plurality of corresponding slots defined in the back plate to simply, securely and detachably snap fasten the housing member to the back plate. Electrical power wires threaded through a hole in the back plate are used to connect the light source to an external power supply. The back plate is mountable to a vehicle license plate mounting assembly. Thus, when fully assembled and in use, light emanating from the light source passes through the non-opaque portions of the display panel to create an illuminated visual image.

6 Claims, 5 Drawing Sheets

ILLUMINATED VEHICLE DISPLAY DEVICE

The present invention relates generally to the field of illuminated display devices and more particularly to a lighted display device for attachment to a motor vehicle or the like.

BACKGROUND OF THE INVENTION

Illuminated license plates and illuminated display panels which may be attached to a motor vehicle in lieu of a license plate are well known in the art. Many of such prior devices involve illumination of the license plate or the display panel by shining light onto the face of the plate or panel. In such devices, the light source is disposed outside and in front of the plate or panel face to radiate light onto opaque display indicia disposed on this face which in turn reflects the light to the viewer, thus illuminating the display indicia.

Other prior art devices were developed which were not dependent on reflection of exterior light but instead involved one or more light sources which were disposed inside a housing behind a display face. Such a light source would then shine light through transparent or translucent portions of the display face to illuminate the desired display indicia for the viewer.

This latter form of illuminated display device has taken many forms and involves numerous different features. Two recent examples include Muñoz (U.S. Pat. No. 4,475,298) and Monroe (U.S. Pat. No. 5,073,842). Both of these patents generally disclose a box-like light source housing having a forwardly disposed opening in which a partially translucent or otherwise partially non-opaque display panel is mounted. The light source in each housing emits light that passes through the translucent or non-opaque portions of the associated display panel to create an illuminated image.

A principal distinction between Muñoz and Monroe (and between other devices similar to each) is that where the Monroe device first transmits light through air within its substantially vacant housing, the Muñoz housing is filled with a solid, light-conductive/light-transmitting material upon which is overlaid a partially opaque shield having non-opaque portions formed therein. Light is then directed into an edge of the Muñoz light-conductive material which disseminates the light to illuminate the entire display area. The visual image is created by the light which emanates from the display material through the non-opaque portions of the shield. Other examples of illumination devices using similar light-conductive materials are disclosed in the U.S. Patents to Aronoff (U.S. Pat. No. 3,349,511), O'Donnell (U.S. Pat. No. 3,406,475), Redick (U.S. Pat. No. 5,150,960), and Ching Hwei (U.S. Pat. No. 5,177,889). Note that Redick and Ching Hwei describe devices which combine elements of the exterior reflection devices (discussed generally above) with the use of light-conductive materials.

On the other hand, the Monroe device (introduced above), is effective without the use of a solid, light-conductive material. In Monroe, light emits from a light source in the housing and radiates through the air in the housing and then out through the non-opaque portions of the display panel mounted in its forwardly disposed opening. Other U.S. Patents for similar devices include those to Marsala (U.S. Pat. No. 2,045,863), Marks (U.S. Pat. No. 2,108,591) Czarny et al. (U.S. Pat. No. 2,122,027), Rioux (U.S. Pat. No. 2,124,829), Dunnam et al. (U.S. Pat. No. 2,156,753), Ducey (U.S. Pat. No. 2,156,806), White (U.S. Pat. No. 2,171,820), Hoover et al. (U.S. Pat. No. 2,203,785), Aydelotte (U.S. Pat. No. 2,305,372), Vokaty (U.S. Pat. No. 2,305,750), Gladd (U.S. Pat. No. 2,875,539), Murai (U.S. Pat. No. 3,521,391) and Flannery (U.S. Pat. No. 3,921,324).

Even in view of the voluminous prior efforts in this art, there still remains a need for illuminated display devices that have improved features for use and easy installation and which reduce light and water leakage. For example, a problem with the Monroe-like devices is that when one is mounted on the front of a motor vehicle, the seam between the display plate and housing where these components engage is subject to light and water leakage. Light leakage can impair the display image of the device while water can affect its operability and/or substantially reduce its effective life. Note, Monroe does address this problem by teaching the placement of a gasket in this seam particularly to combat water entry. Further, the standard screw attachments of the display plates to the prior art housings are relatively complex in that they require laborious and time-consuming efforts, both during installation and in maintaining, replacing or repairing interior elements such as a light source or a display panel.

BRIEF SUMMARY OF THE INVENTION

The present invention is, generally, an illuminated vehicle display device and more particularly comprises a flat back plate having a light source disposed thereon, and a front, box-like housing member which has a rearwardly disposed opening so that the housing member encloses the light source when it is detachably attached to the flat back plate. The flat back plate is mountable to a conventional motor vehicle license plate mounting assembly and has various apertures for this and other purposes including a plurality of slots for the attachment of the housing member to the back plate. The front housing member has a partially translucent or otherwise partially non-opaque display panel disposed in a window defined through the front wall of the housing member. A plurality of protruding tab members defined in the housing member coact with the plurality of corresponding slots on the back plate to simply, securely and detachably snap fasten the housing member to the back plate. Electrical power wires threaded through a hole in the back plate are used to connect the light source to an external power supply. Thus, when fully assembled and in use, light emanating from the light source passes through the non-opaque portions of the display panel to create an illuminated visual image.

Accordingly, the primary object of this invention is to provide an improved illuminated vehicle display device that creates a desirable illuminated visual image.

Another object of the present invention is to provide a new and improved illuminated display device which is inexpensive to manufacture, easy to install and which allows pre-selected display designs to be readily interchanged.

A still further object of the present invention is to provide a new and improved illuminated display device which is water resistant to protect the electrical circuitry thereof from water damage.

These and still further objects as shall hereinafter appear are readily fulfilled by the present invention in a remarkably unexpected manner as will be readily discerned from the following detailed description of an exemplary embodiment thereof especially when read in conjunction with the accompanying drawings in which like parts bear like numerals throughout the several views.

DESCRIPTION OF THE PREFERRED EMBODIMENT

Figure 1:
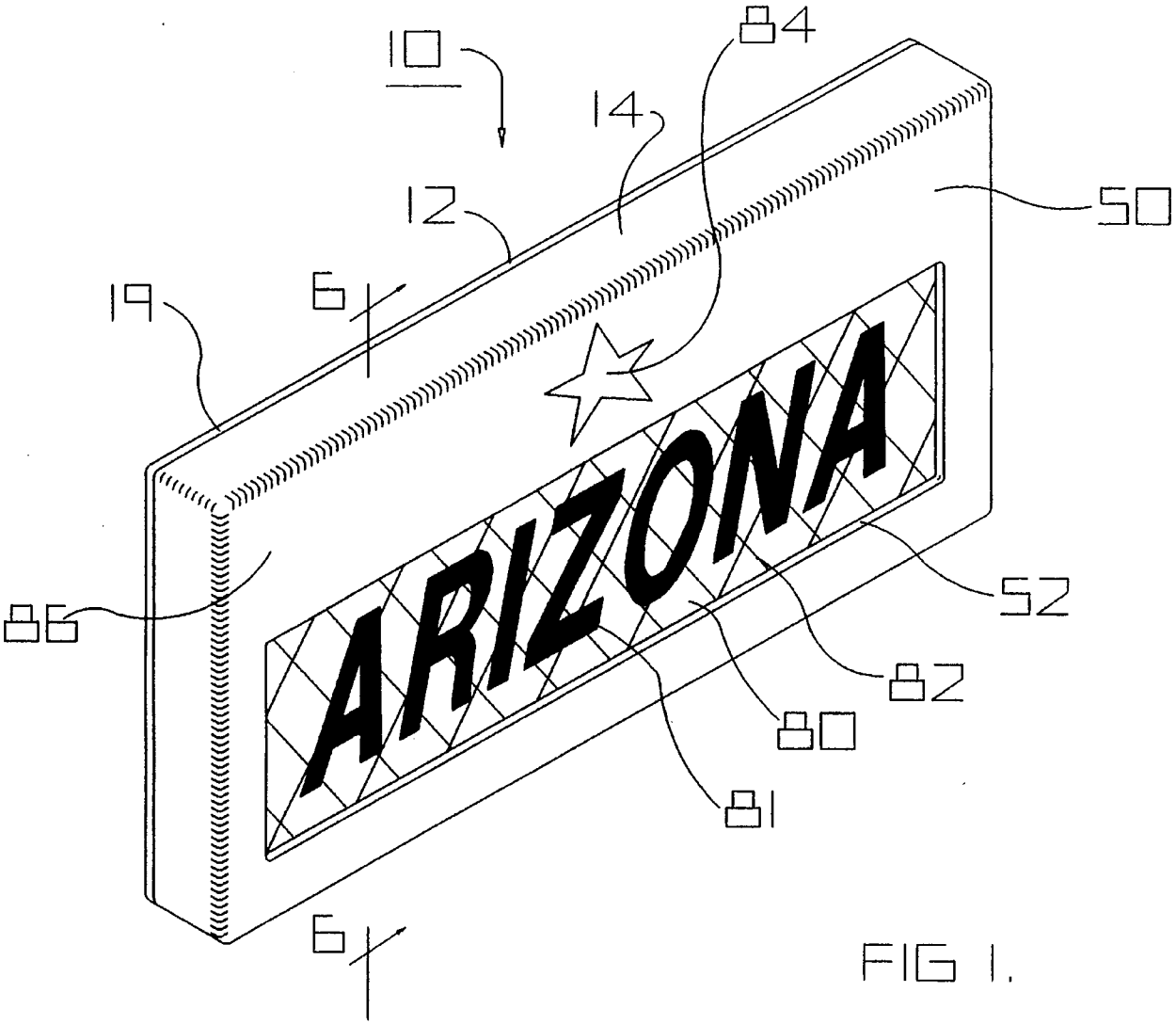
FIG. 1 is an isometric view of an illuminated vehicle display device of the present invention.

The present invention is an illuminated display device for a motor vehicle which is identified in FIG. 1 by the general reference numeral 10. Illuminated device 10 generally comprises two main structural elements, namely, a flat back plate 12 and a front, box-like housing member 14.

Figure 2:
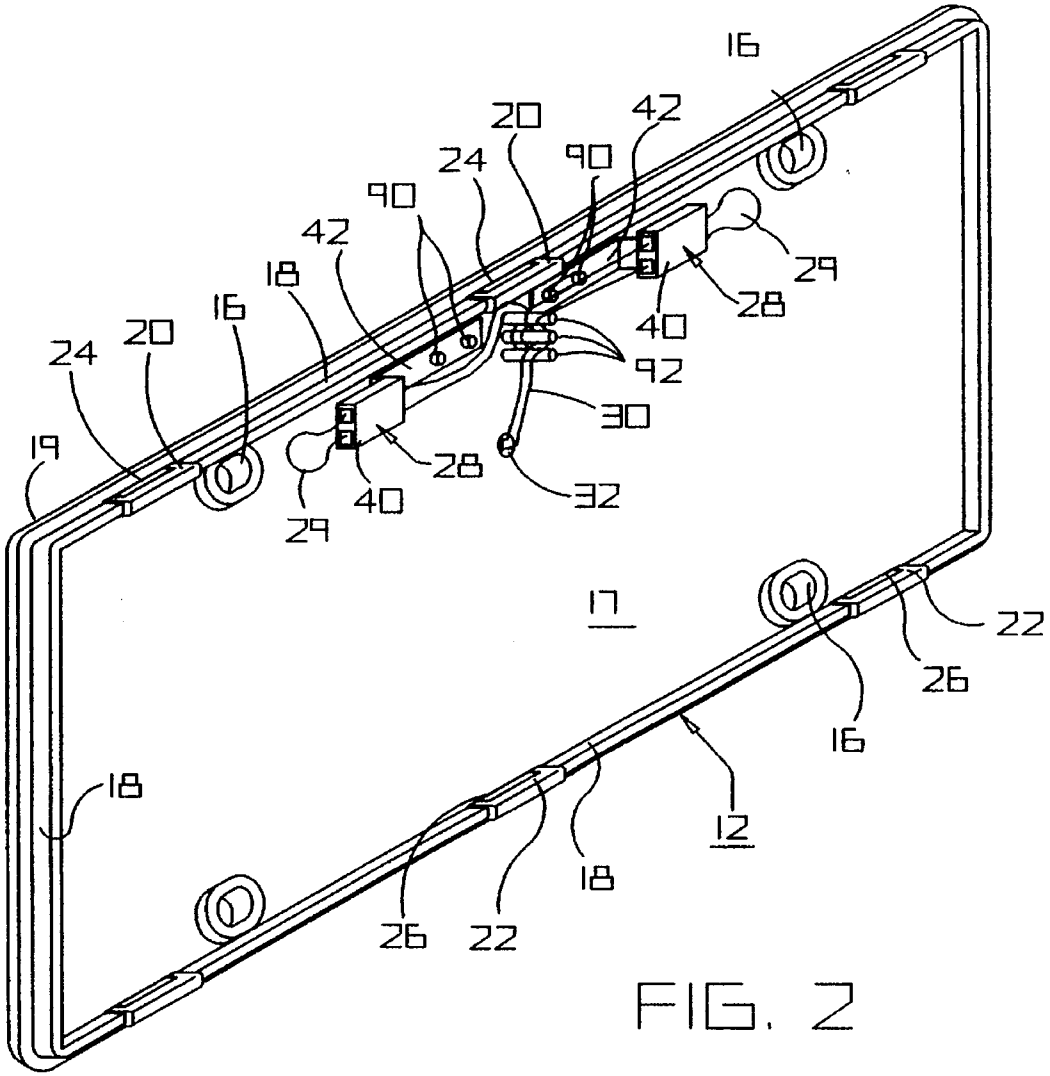
FIG. 2 is an isometric view of the flat back plate of the illuminated vehicle display device shown in FIG. 1.
Figure 3:
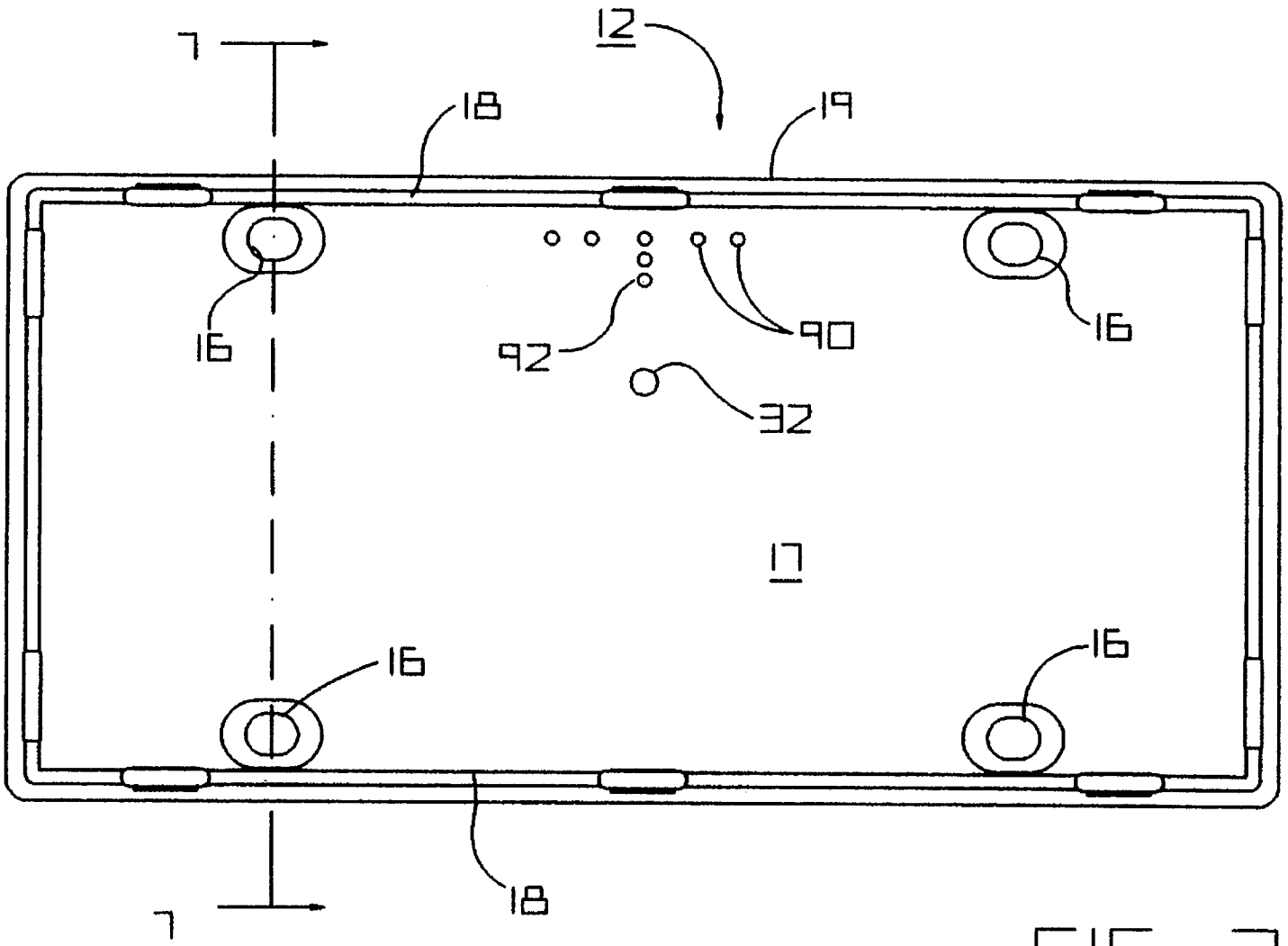
FIG. 3 is a plan view of the flat back plate of FIG. 2.
Figure 7:
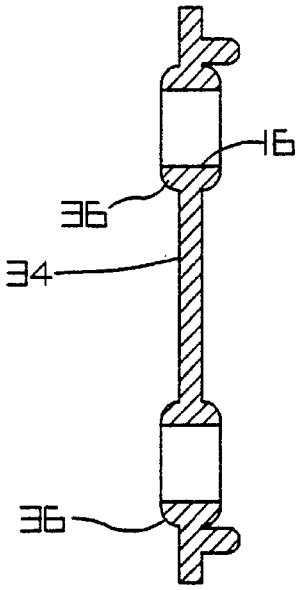
FIG. 7 is a cross-sectional view of the flat back plate of FIG. 3 taken on line 7—7 thereof.

As shown in FIGS. 2 and 3, flat back plate 12 has means such as apertures 16 defined therethrough for securing plate 12 to the vehicle's front license plate support structure (not shown) in lieu of a license plate. On the front surface 17 of flat back plate 12 is an outwardly projecting ridge 18 adjacent the plate perimeter 19 and inset from about ⅛ to about ¼ of an inch therefrom in generally parallel relationship thereto. Ridge 18 is generally rectangular or otherwise shaped to conform to perimeter 19 and, as described below, facilitates the detachable attachment of front housing 14 to back plate 12. Upper and lower flange portions 20, 22 respectively, of ridge 18 have a plurality of spaced slots 24, 26 defined therein to facilitate this detachable attachment which will be explained in greater detail below. Flat back plate 12 further comprises support means for mounting and activating one or more light sources 28 which are disposed within device 10. Power access is gained through known means such as suitable wires 30 which are connected to light sources 28 at one end in standard fashion and threaded or reeved through a hole 32 defined in back plate 12 for connection with the vehicle's electrical supply (not shown) at the other end thereof. As shown in FIG. 7, the rear surface 34 of back plate 12 has protruding structures 36 circumscribing each attachment aperture 16 which are useful to prevent back plate 12 from lying flush against the vehicle bumper to thereby define adequate space therebetween in which power supply wiring 30 may be freely passed between device 10 and the vehicle.

FIG. 2 also shows the details of the preferred light sources 28 which include light bulbs 29 inserted in socket members 40 which are attached to angled brackets 42. Angled brackets 42 serve to securely attach light sources 28 to front surface 17 of back plate 12, and yet maintain light bulbs 29 sufficiently away from front surface 17 so that bulbs 29 do not contact front surface 17 for a variety of purposes including the prohibition of any burning or melting or other damage to any of these members. The preferred method for connecting light sources 28 to back plate 12 will be described below.

Figure 4:
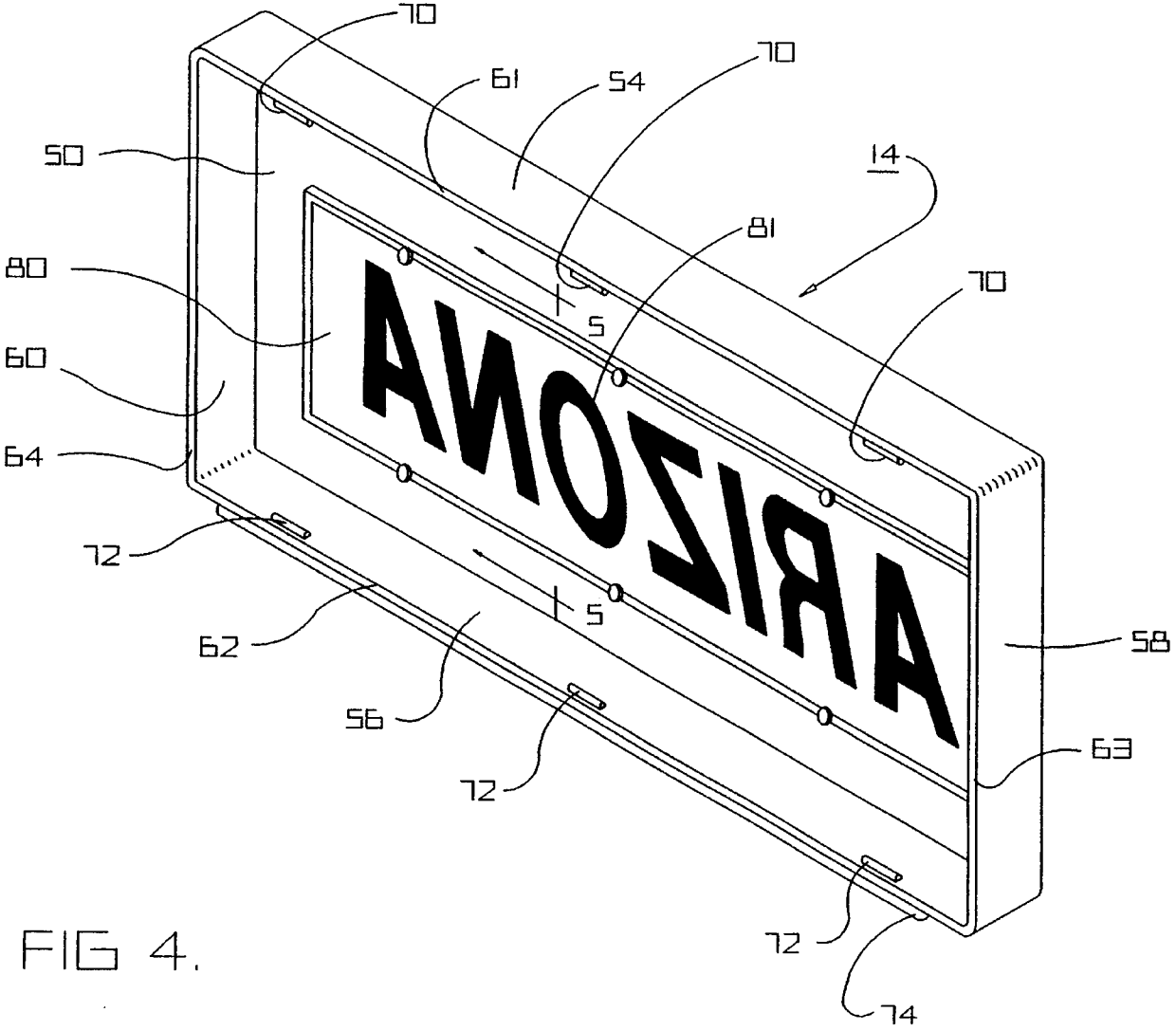
FIG. 4 is an isometric view showing the interior of the front housing member of the illuminated vehicle display device shown in FIG. 1.

Front housing member 14 is an integral, rectangular box-like structure having a front wall 50 having a window 52 defined therethrough. As shown best in FIG. 4, housing member 14 is further defined by a top wall 54, a bottom wall 56, and two side walls 58 and 60, respectively. Housing member 14 further comprises a rearwardly disposed opening defined by the rear edges 61, 62, 63 and 64 respectively of top wall 54, bottom wall 56 and side walls 58 and 60. Rear edges 61–64 preferably form a rectangle which is just larger than ridge 18 on back plate 12 so that housing member 14 can engage back plate 12 by having top, bottom and side walls 54, 56, 58 and 60 smoothly abut the outside edges of ridge 18 in circumscription thereabout.

Further, tab members 70, 72 which are used for securing housing 14 to back plate 12, respectively project downwardly from top wall 54 (members 70) and upwardly from bottom wall 56 (members 72) and are disposed adjacent the rearwardly disposed opening in registry with their respective interactive slots 24, 26 defined in ridge 18 of back plate 12. This tab/slot design facilitates the preferred detachability such that front member 14 can be easily removed from back plate 12 during installation or maintenance. Tab members 70 on top wall 54 preferably extend further toward the center of housing member 14 than do tab members 72 on bottom wall 56 as shown most particularly in FIG. 6 for the primary purpose to be described further below. A flange 74 is disposed along the exterior side of bottom wall 56 and depends therefrom to also facilitate the detachability of front member 14 from back plate 12. Flange 74 is also preferably adjacent the rearwardly disposed opening.

Figure 5:
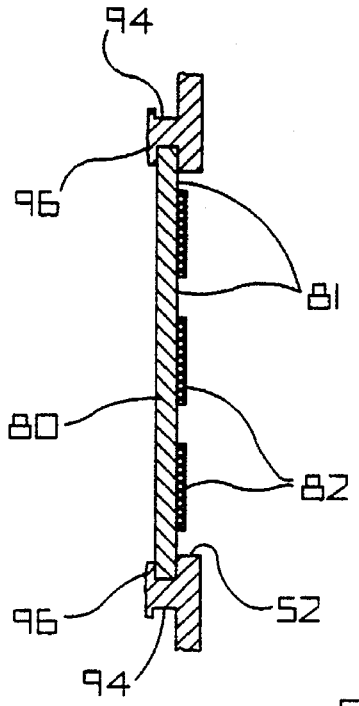
FIG. 5 is a fragmented cross-sectional view of the partially non-opaque display panel as attached to the front housing member of FIG. 4 taken on line 5—5 thereof.

As shown in FIG. 5, window 52 includes means (as will be described below) for supporting a display panel 80 having illuminatable indicia 81 defined thereon. Such indicia may take the form of letters, numbers, borders or mere designs which are capable of ready illumination and visualization. Indicia 81 are preferably the exposed, non-opaque portions of a translucent or transparent (i.e. non-opaque) display panel 80 defined by the coaction of display panel 80 with strategically placed opaque paint 82 or a similar shielding material affixed to display panel 80. The resulting visual image comes from the passage of light through the unblocked, non-opaque portions of display panel 80.

When assembled as described below and the internal light sources 28 are activated, the light from bulbs 29 (or other, alternative lighting means) within device 10 passes through the unblocked, non-opaque portions of display panel 80 thereby creating a visual image. It will be noted that in daylight, the indicia is rendered visible without the use of light sources 28 if opaque paints 82 (or other shielding materials) are used which create a strong visual contrast with the non-opaque portions of panel 80.

Referring again to FIG. 1, optional, non-illuminated indicia 84 may be added to front housing member 14 on a strategically defined opaque section 86 of front wall 50. Conventional stencilling or other known methods could be used for creating this image. Image 84 will be visible during the day but not necessarily at night since the light from sources 28 passes only through the non-opaque portions of panel 80 to illuminate indicia 81 and does not pass through or otherwise light up the other exterior surfaces of housing 14.

The preferred embodiment is generally constructed of substantially rigid plastic materials that can be injection molded into the preferred rectangular shapes shown and described herein. More particularly, back plate 12 and housing member 14 are separately formed by injection molding (or other known and accepted techniques) into the shapes substantially as shown in the attached drawings. Then, one or more conventional electrical light sources 28 are attached to back plate 12 in the configuration shown in FIG. 2. In the preferred process, back plate 12 has one or more small protuberances 90 extending outwardly from front side 17 of back plate 12 on which each light source 28 (or other, alternative light emitting devices) may be attached. Securing this attachment may be accomplished through the use of screws, clips or other known methods. However, a preferred method involves affixing each angle bracket 42 of each light source 28 to one or more protuberances 90 by moving each bracket 42 into its attachment position such that one or more protuberances 90 are inserted through corresponding holes preformed in each bracket 42; then the ends of small protuberances 90 are heat staked, i.e., melted, so that they can be folded or otherwise pushed down to secure each light source 28 firmly in place on back plate 12. One such method for melting protuberances 90 may involve merely touching their exposed ends with a hand-held heating device such as a soldering iron. Other methods could also be used. Standard wires 30 are then attached in conventional fashion to the corresponding socket member 40 of each light source 28 and are then threaded or reeved through hole 32 to be attached to the vehicle power supply also in known fashion. Large protuberances 92 are formed on back plate 12 for stabilizing wires 30. Wires 30 may thus be wrapped around large protuberances 92 so that they will not become easily disconnected from light sources 28.

Housing member 14 is formed with a window 52 defined in front wall 50 so that a display panel 80 can be firmly seated therein. Still further small protuberances 94 (see FIG. 5) are formed around and adjacent the inner periphery of window 52 so that when panel 80 is set in place, the exposed ends of protuberances 94 may be heat staked or melted so that they may be folded down to form stops 96 which hold panel 80 in place. This melting process might occur as described above. In a preferred practice of the present invention, window 52 will be smaller than the entire front wall 50 of housing member 14 leaving an opaque front portion 86 (see FIG. 1) intact and impermeable to light. Preferably, light bulbs 29 and light sources 28 will be disposed directly behind opaque front portion 86 so that the light emanating therefrom diffuses evenly through panel 80 and thereby creates no "hot spots" or uneven bright areas which would detrimentally affect the resulting visual image.

Display panel 80 is a translucent or transparent plastic or glass plate that has opaque paint 82 or other shielding material affixed thereto in predetermined patterns leaving one or more non-opaque portions 81 showing through. As shown in FIGS. 1 and 5, non-opaque portions 81 include letters and a border. Again, numerous conceivable patterns are usable herewith, and these patterns can be preformed in or on panel 80 during the manufacture of panel 80 if desired. Glazing or other finishing products can also be used for known purposes and according to known methods in the art.

To install and use device 10 which has been manufactured as described above, back plate 12 (having light sources 28, bulbs 29 and wiring 30 predisposed thereon) is, if necessary (due, for example, to having been prepackaged as an assembled unit), separated from housing member 14 and attached to a vehicle, preferably on the front bumper in lieu of the license plate (this device is not meant to be substituted for a front license plate in those jurisdictions that do require front license plates). Mounting apertures 16 are thus preferably pre-formed to be in registry with the mounting holes of a standard front license plate mounting frame on a motor vehicle. Thus, back plate 12 is attached by screws (or by other standard means) through mounting apertures 16 to the vehicle's front license plate mounting frame. Wires 30 are reeved or threaded through hole 32 and run to the vehicle's power supply and attached thereto in standard fashion. Note, if connected to the circuit which includes the headlights or other running lights, then device 10 can be toggled on and off simultaneously with the other vehicle lights.

Figure 6:
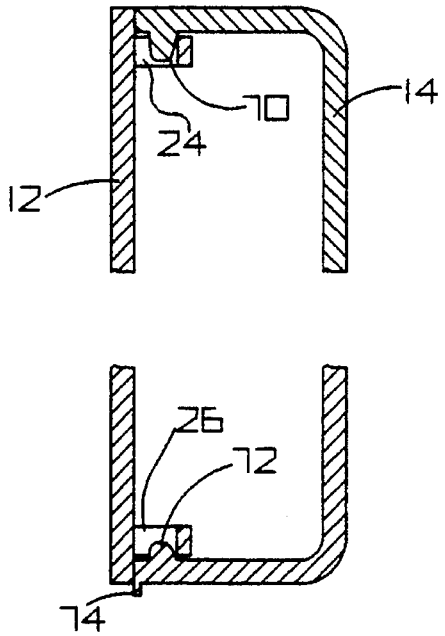
FIG. 6 is a fragmented cross-sectional view of the illuminated vehicle display device of FIG. 1 taken on line 6—6 thereof.

Housing member 14 (having a display panel 80 already fixed therein) may then be snap fastened to this mounted back plate 12 in the following manner. First, the larger tabs 70 which depend from top wall 54, are nestled in corresponding slots 24 in back plate 12. Then, lower wall 56 with smaller tabs 72 is swung into position (as shown in FIG. 6) so that tabs 72 can be snapped into their corresponding slots 26. Note, it is preferable for housing member 14 to be substantially rigid yet sufficiently pliable so that bottom wall 56 can slightly deform or expand and then return to its original form without breaking to thereby accommodate this snap fastening process. Having tab members 72 formed to be smaller than tab members 70 also facilitates this snap fastening operation so that bottom wall 56 need not deform an inordinate amount.

As mentioned above, light sources 28 can then be toggled on or off with the rest of the vehicle's lighting system when desired. Note again that if there is provided sufficient contrast between the opaque paint 82 (or other shielding materials) and the non-opaque portions of display panel 80, then during the day the entire image would be visible including any indicia 84 added to opaque portion 86 of front wall 50. Further, at night, when light sources 28 are activated, the non-opaque portions of display panel 80 are illuminated as described above to create a desirable visual image.

Flange 74 may then be used to quickly remove housing member 14 from back plate 12 for routine maintenance or for substituting a new or different housing member 14 with different indicia 81 to obtain a different visual image. Flange 74 is grasped and pulled downwardly and outwardly from back plate 12 to disengage tab members 72 from slots 26. Then housing member 14 is lifted up to disengage or remove tabs 70 from slots 24. Maintenance, for example, cleaning or replacing burnt out light bulbs, can then be performed and/or a different housing member 14 can be interchangeably used on mounted back plate 12 as described above.

Alternative fastening means are conceivable for the attachments of several of the above described components. For example, an alternative to the described heat staking of display panel 80 into position in housing member 14 may include the use of speed nuts, known self-locking fasteners, which may be pushed into place on protuberances 94 or the like to self-lock against panel 80 to hold panel 80 in place. Another alternative includes preforming a plurality of tabs extending toward the center of window 52 and having them disposed around and adjacent the periphery of window 52. These tabs would operate in a fashion similar to the tab/slot design described for the attachment of housing member 14 to back plate 12. Here, though, panel 80 would not necessarily have any slots, rather it would be inserted under, for example, the top tabs and then panel 80 would be pushed against the remaining tabs until it snaps into place under the tabs. Again, the tab material would have to be sufficiently resilient to deform under such pressure and then snap back into its original position.

A still further alternative is to form panel 80 contemporaneously as a portion of the entire housing member 14 which would then be molded as one complete unit. Thus, in this form, a completely separate panel 80 is unnecessary as it becomes identically coincident with window 52 in meaning and substance. This is according to the contemporary, accepted definition of a window which is "an opening . . . for letting in light or air." *Webster's New World Dictionary,* Third College Edition. In other words, the word window as used herein is intended to encompass both air and light passageways, alternatively and cumulatively. Thus, a window 52 defined through a front wall 50 of a housing member 14 which allows the passage of light (but not air, for example), would thus be functionally and structurally the same as a display panel 80 formed contemporaneously with and probably of the same material as front wall 50, and such descriptive terminology (window 52/panel 80) could thus be used interchangeably for the same light transmissive structure. A housing 14 could therefore be constructed with non-opaque (i.e., light transmitting only) portions formed directly therein and still be within the scope of this invention. Opaque portions would then be created in the fashion described above even though the shielding material may need to be applied to a greater surface area of housing 14 including, for example, at one extreme, to top, bottom and side walls 54, 56, 58, and 60 if housing 14 is constructed completely non-opaque.

One other point regarding the preferred embodiment is that the non-opaque portions of display panel 80 which create illuminatable indicia 81 are preferably, as shown in FIG. 5, the blackened letters and borders. The background would thus be the opaque portions formed by opaque paint 82 which is shown as the cross-hatched area of panel 80. Thus, when activated, light would show through indicia 81 and light the letters for visualization. Of course, the converse is also possible as well where indicia 81 would be the background and the letters would be opaque as formed by paint (for other shielding material) 82. Thus, when activated, light would shine through the background area and the letters would be visible as the opaque contrast to the lighted background.

From the foregoing, it is readily apparent that a new and useful embodiment of the present invention has been herein described and illustrated which fulfills all of the aforestated objects in a remarkably unexpected fashion. It is of course understood that such modifications, alterations and adaptations as may readily occur to the artisan confronted with this disclosure are intended within the spirit of this disclosure which is limited only by the scope of the claims appended hereto.

Accordingly, what is claimed is:

1. An illuminated display device for attachment to a motor vehicle comprising:

a substantially rectangular, substantially flat back plate having a front side, a back side, a perimeter, and means for attaching said back plate to a motor vehicle; said back plate further having a protruding ridge defined on said front side and inset from the perimeter of said back plate, said protruding ridge having a plurality of slots defined therein; said back plate further having a light source affixed on said front side thereof and having an aperture defined therein for receiving electrical wires therethrough, said wires adapted to connect said light source to an exterior power source; and a substantially rectangular, box-like front housing member having a front wall, a top wall, a bottom wall, first and second side walls, and a rearwardly disposed opening, said top wall and said bottom wall each having an interior side and an exterior side, said housing member being adapted to be detachably secured to said back plate with said rearwardly disposed opening being positioned adjacent to and abutting said protruding ridge in circumscription thereabout; said housing member having a first plurality of tab members disposed on the interior side of said top wall and a second plurality of tab members disposed on the interior side of said bottom wall, all of said tab members being adjacent said rearwardly disposed opening, and each tab member being disposed in a corresponding one of said slots defined in said protruding ridge defined on said back plate; said front wall having a window defined through a portion thereof, said window having a display panel disposed therein, said display panel having opaque and non-opaque portions defined therein and arranged to define a preselected pattern when said device is illuminated; said front wall having an intact opaque portion not interrupted by said window, said intact opaque portion of said front wall being disposed to block the direct transmission of light from said light source; and said bottom wall having a flange disposed on the exterior side of said bottom wall adjacent said rearwardly disposed opening.

2. An illuminated display device according to claim 1 in which the tab members disposed on the interior side of said top wall of said housing member are larger than the tab members disposed on the interior side of said bottom wall.

3. An illuminated display device according to claim 1 in which said attachment means comprises a plurality of apertures defined through said back plate in registry with said motor vehicle license plate mounting assembly.

4. An illuminated display device according to claim 3 in which said back plate has a plurality of protruding structures defined on the back side of said back plate and each of said protruding structures is disposed about each of said plurality of apertures.

5. An illuminated display device according to claim 1 in which said back plate has a plurality of protruding structures defined on the back side of said back plate.

6. An illuminated display device according to claim 1 in which said opaque portion of said front wall of said housing member has opaque indicia formed thereon.

* * * * *